US010214308B2

(12) United States Patent
Yu Chen

(10) Patent No.: US 10,214,308 B2
(45) Date of Patent: Feb. 26, 2019

(54) LONG-HANDLE FILM PACKING DEVICE

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 334 days.

(21) Appl. No.: 15/075,816

(22) Filed: Mar. 21, 2016

(65) Prior Publication Data

US 2017/0267387 A1 Sep. 21, 2017

(51) Int. Cl.
*B65B 67/08* (2006.01)
*B65H 75/24* (2006.01)

(52) U.S. Cl.
CPC ..... *B65B 67/085* (2013.01); *B65H 75/241* (2013.01); *B65H 2402/412* (2013.01); *B65H 2511/12* (2013.01); *B65H 2701/1752* (2013.01); *B65H 2701/1944* (2013.01)

(58) Field of Classification Search
CPC ..... B65H 75/241; B65H 16/005; B65H 2701/1944; B65H 2701/1752; B65H 2511/12; B65H 2801/81; B65B 67/085
See application file for complete search history.

(56) References Cited

U.S. PATENT DOCUMENTS 4,477,037 A * 10/1984 Goldstein ..... B65B 67/085 242/423.2
4,714,211 A * 12/1987 Hwang ..... B65B 67/085 242/423.1
7,357,349 B1 * 4/2008 Huang ..... B65B 67/085 242/405.3
7,845,382 B1 * 12/2010 Melino, Sr. ..... B65H 35/0006 156/574
2007/0095025 A1 * 5/2007 Yu Chen ..... B65B 67/085 53/556
2007/0151208 A1 * 7/2007 Huang ..... B65B 67/085 53/390
2009/0308968 A1 * 12/2009 Piotrowski ..... B65H 75/242 242/573.2
2012/0325956 A1 * 12/2012 Morgan ..... B65H 75/10 242/588.2
2015/0203232 A1 * 7/2015 Nelson ..... B65B 67/085 242/422.4
2016/0355293 A1 * 12/2016 Clarke ..... B65B 59/04

* cited by examiner

*Primary Examiner* — William A. Rivera
(74) *Attorney, Agent, or Firm* — Ming Chow; Sinorica, LLC

(57) ABSTRACT

A long-handle film packing device includes a first rod and a second rod connected with each other. The first rod is formed with an axial limit groove. The second rod is provided with a limit member corresponding to the limit groove. Through the limit member limited to the limit groove, the length of the long-handle film packing device can be adjusted quickly. Through a positioning pin, the long-handle film packing device can be positioned quickly. The present invention can be applied to different lengths of packing film rolls. In addition, the packing film roll can be first mounted, and then the length of the film packing device is adjusted. Except that the length of the present invention can be adjusted and positioned quickly, the present invention has better practicability and convenience for installation.

8 Claims, 8 Drawing Sheets

LONG-HANDLE FILM PACKING DEVICE

BACKGROUND OF THE INVENTION

1. Field of the Invention

The present invention relates to a film packing device, and more particularly to a long-handle film packing device.

2. Description of the Prior Art

In order to prevent articles from being damaged during storage or transportation, a film packing device is used to pack articles. A conventional film packing device comprises a base. The base is provided with a connecting rod. When the user wants to pack an article, a packing film roll is fitted on the connecting rod. The packing film roll is wound with packing film. When in use, the user first pulls the packing film out and holds the base. The film packing device is moved toward the article to be packed to complete the packing procedure. However, if the packing film roll is shorter than the connecting rod, the tension of the packing film won't be enough. This increases the difficulty of packing. If the packing film roll is longer than the connecting rod, the packing film roll cannot be mounted on the film packing device. The conventional film packing device cannot be applied to different lengths of packing film rolls, which is inconvenient for use. Accordingly, the inventor of the present invention has devoted himself based on his many years of practical experiences to solve these problems.

SUMMARY OF THE INVENTION

The present invention is to provide a long-handle film packing device. The length of the film packing device can be adjusted and positioned quickly. The film packing device has better practicability and convenience.

In order to achieve the aforesaid object, the long-handle film packing device of the present invention comprises a first rod, a first cover, a second cover, a second rod, and a positioning pin. The first rod has an adjustment rod. An outer wall of the adjustment rod is formed with an axial limit groove. The limit groove extends from a first end of the adjustment rod toward a second end of the adjustment rod. The first rod is formed with a plurality of spaced positioning holes at a bottom of the limit groove. The second end of the first rod is fixedly connected with a first handle. The first cover is fitted on the adjustment rod and located between the first positioning holes and the first handle. The first cover leans against the first handle. The second cover is fitted on the adjustment rod. The second rod has a holding rod. The holding rod has an axial hole for receiving the adjustment rod. The holding rod is provided with a limit member close to a first end of the holding rod. The holding rod is formed with at least one second positioning hole located close to the limit member and corresponding to the first positioning holes. Between a second end of the holding rod and the second positioning hole is threadedly connected with a knob. The holding rod is sleeved with a second handle. One end of the second handle leans against the knob. A free end of the second handle leans against the second cover. An outer wall of the second handle is axially formed with a slot corresponding to the first positioning holes and the second positioning hole. The positioning pin is inserted in the slot of the second handle, the second positioning hole of the holding rod, and one of the first positioning holes of the first adjustment rod.

The limit member of the long-handle film packing device of the present invention is limited to the limit groove, so that the length of the long-handle film packing device can be adjusted quickly. Through the positioning pin, the long-handle film packing device can be positioned quickly. The present invention can be applied to different lengths of packing film rolls. In addition, the packing film roll can be first mounted, and then the length of the film packing device is adjusted. Except that the length of the present invention can be adjusted and positioned quickly, the present invention has better practicability and convenience for installation.

DETAILED DESCRIPTION OF THE PREFERRED EMBODIMENTS

Embodiments of the present invention will now be described, by way of example only, with reference to the accompanying drawings.

Figure 1:
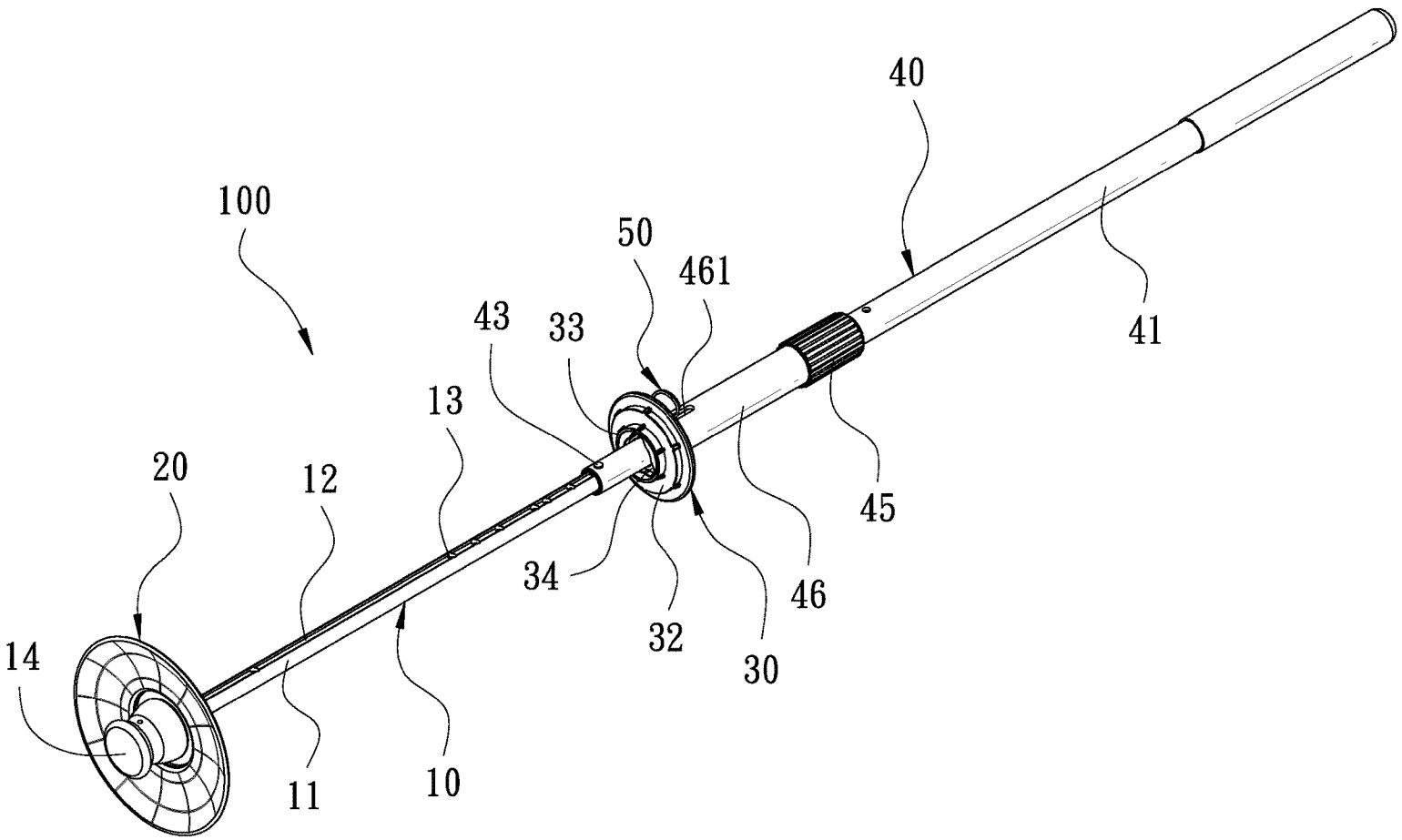
FIG. 1 is a perspective view of the present invention.
Figure 2:
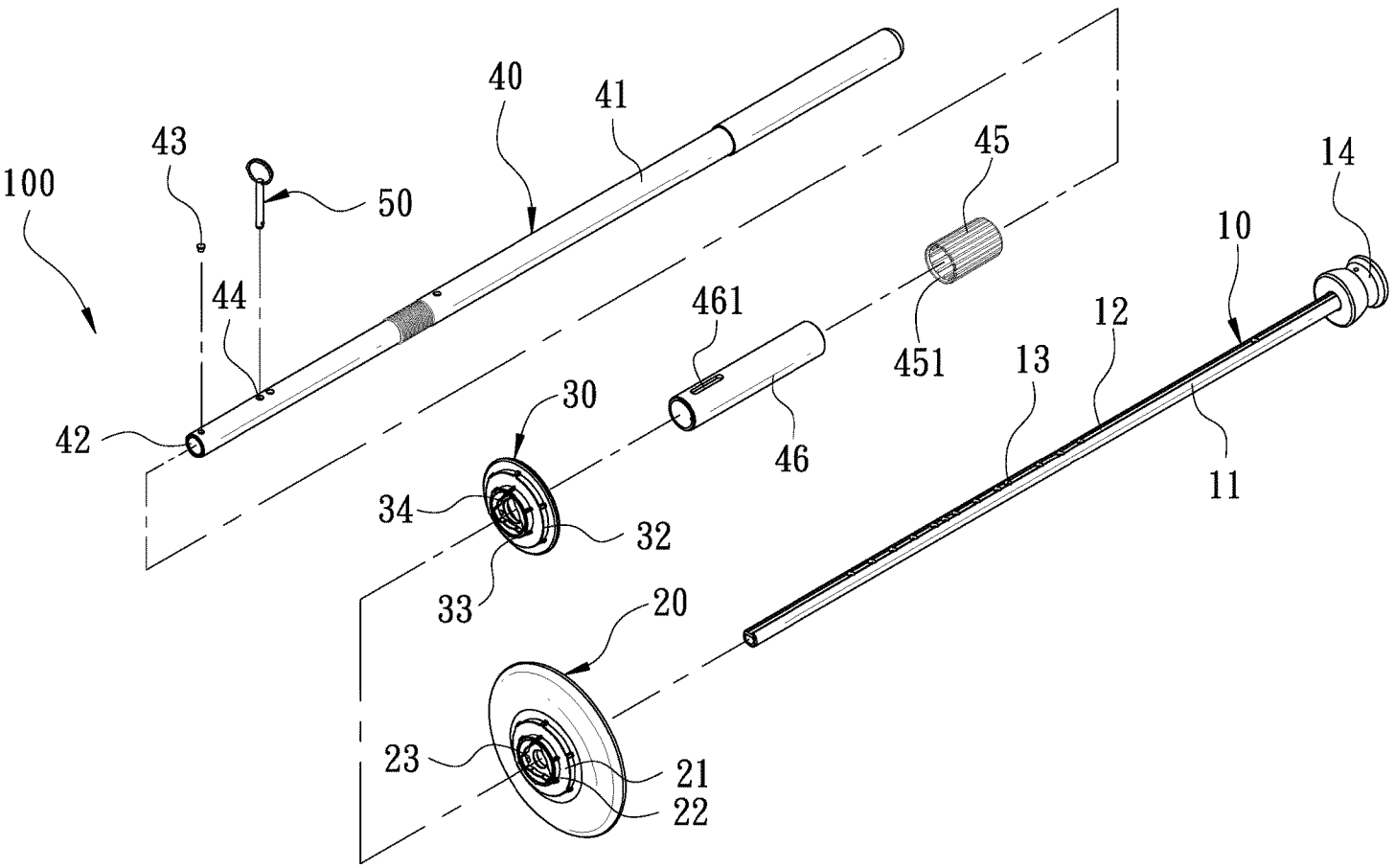
FIG. 2 is an exploded view of the present invention.
Figure 3:
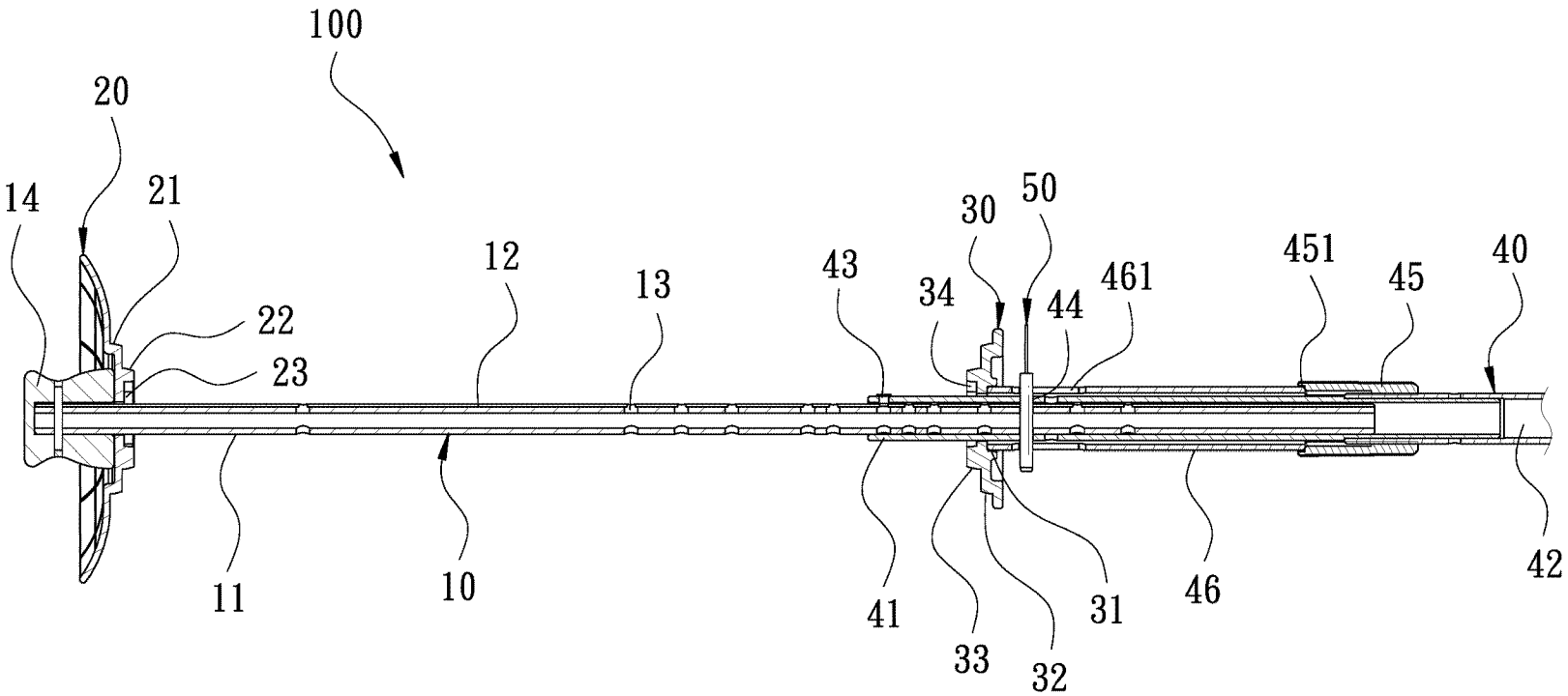
FIG. 3 is a partial sectional view of the present invention.

FIG. 1 is a perspective view of the present invention. FIG. 2 is an exploded view of the present invention. FIG. 3 is a partial sectional view of the present invention. The present invention discloses a long-handle film packing device 100. The long-handle film packing device 100 comprises a first rod 10, a first cover 20, a second cover 30, a second rod 40, and a positioning pin 50.

The first rod 10 has an adjustment rod 11. An outer wall of the adjustment rod 11 is formed with an axial limit groove 12. The limit groove 12 extends from a first end of the adjustment rod 11 toward a second end of the adjustment rod 12. The first rod 10 is formed with a plurality of spaced positioning holes 13 at the bottom of the limit groove 12. Furthermore, the second end of the first rod 10 is fixedly connected with a first handle 14.

The first cover 20 is fitted on the adjustment rod 11 and located between the first positioning holes 13 and the first handle 14. The first cover 20 leans against the first handle 14. In the present invention, one side of the first cover 20, facing the first positioning holes 13, is provided with a disk-shaped first receiving block 21 and a disk-shaped second receiving block 22 on top of the first receiving block 21. The first receiving block 21 has a diameter greater than that of the second receiving block 22. The diameter of the first receiving block 21 is three inches, and the diameter of the second receiving block 22 is two inches. A top of the second receiving block 22 is formed with a first receiving recess 23.

The second cover 30 is fitted on the adjustment rod 11. One side of the second cover 30, facing the first end of the adjustment rod 11, is formed with a first trough 31. In the present invention, another side of the second cover 30, facing the first cover 20, is provided with a disk-shaped third receiving block 32 corresponding to the first receiving block 21 and a disk-shaped fourth receiving block 33 on top of the third receiving block 32 corresponding to the second receiving block 22. The third receiving block 32 has a diameter greater than that of the fourth receiving block 33. The diameter of the third receiving block 32 is three inches, and the diameter of the fourth receiving block 33 is two inches. A top of the fourth receiving block 33 is formed with a second receiving recess 34 corresponding to the first receiving recess 23.

The second rod 40 has a holding rod 41. The holding rod 41 has an axial hole 42 for receiving the adjustment rod 11. The holding rod 41 is provided with a limit member 43 close to a first end of the holding rod 41. The limit member 43 corresponds to the limit groove 12. In the present invention, the limit member 43 is a pin. The limit member 43 penetrates through the outer wall of the holding rod 41 and extends out of the inner wall of the holding rod 41. The holding rod 41 is formed with at least one second positioning hole 44 located close to the limit member 43 and corresponding to the first positioning holes 13. Between a second end of the holding rod 41 and the second positioning hole 44 is threadedly connected with a knob 45. One side of the knob 45, facing the second positioning hole 44, is formed with a second trough 451. The holding rod 41 is sleeved with a second handle 46. One end of the second handle 46 leans against the second trough 451 of the knob 45. A free end of the second handle 46 leans against the first trough 31 of the second cover 30. An outer wall of the second handle 46 is axially formed with a slot 461 corresponding to the first positioning holes 13 and the second positioning hole 44.

The positioning pin 50 is inserted in the slot 461 of the second handle 46, the second positioning hole 44 of the holding rod 41, and one of the first positioning holes 13 of the first adjustment rod 11.

Figure 4:
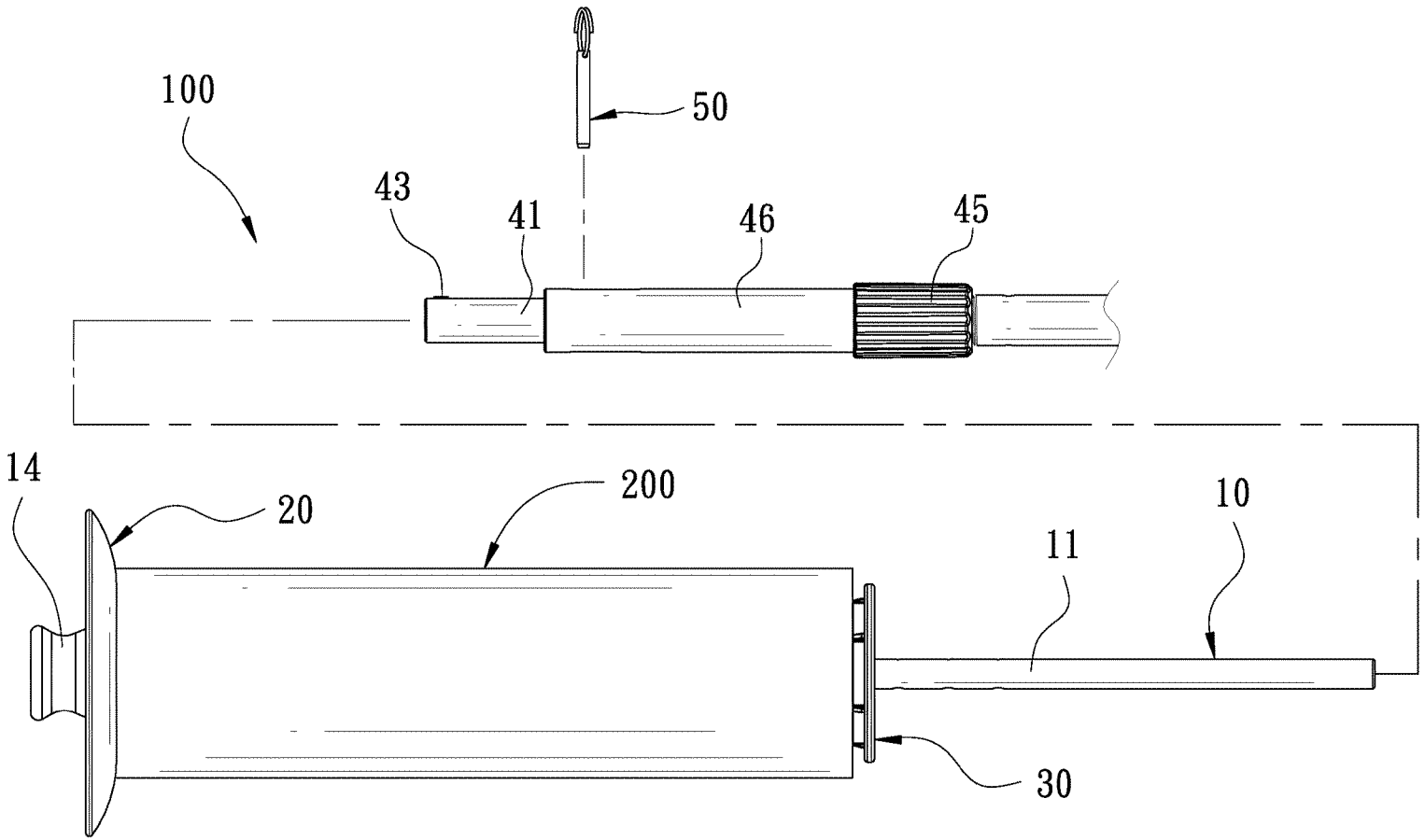
FIG. 4 is a side view according to a first embodiment of the present invention before assembled.
Figure 5:
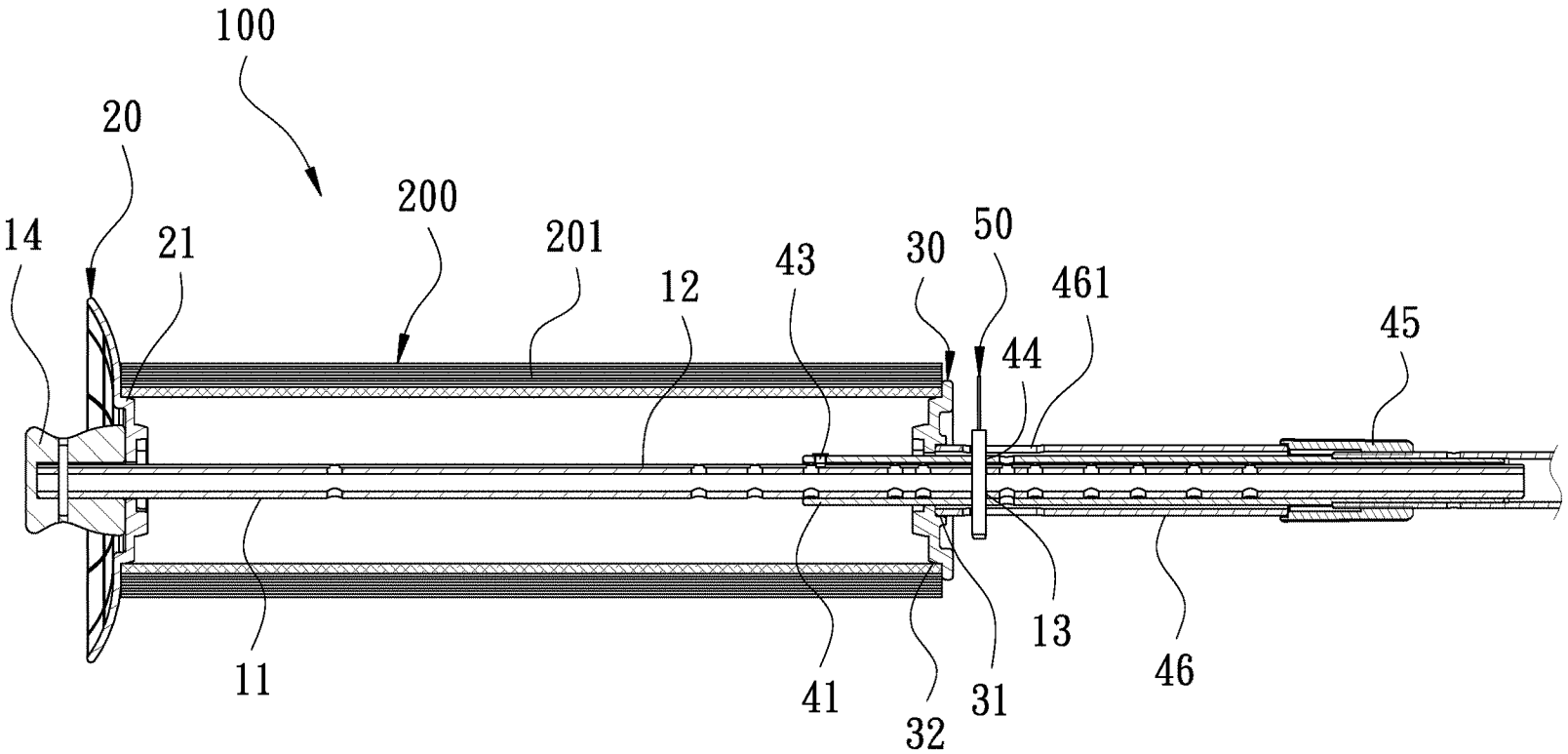
FIG. 5 is a partial sectional view according to the first embodiment of the present invention after assembled.

FIG. 4 is a side view according to a first embodiment of the present invention before assembled. FIG. 5 is a partial sectional view according to the first embodiment of the present invention after assembled. Referring to FIG. 1 to FIG. 3, when the user wants to use the long-handle film packing device 100 to pack an article, a packing film roll 200 is first fitted on the adjustment rod 11. The packing film roll 200 is wound with packing film 201. In this embodiment, the packing film roll 200 is a three-inch packing film roll. One end of the packing film roll 200 is engaged with the first receiving block 21 of the first cover 20. The third receiving block 32 of the second cover 30 is engaged with another end of the packing film roll 200. After that, the limit member 43 is aimed at the limit groove 12 of the adjustment rod 11. Through the limit member 43, the holding rod 41 is connected to the adjustment rod 11. The holding rod 41 can be moved according to the length of the packing film roll 200. After the holding rod 41 is adjusted and positioned, one side of the second handle 46 leans against the first trough 31 of the second cover 30. The positioning pin 50 is inserted in the slot 461 of the second handle 46 to pass through the second positioning hole 44 of the holding rod 41 and one of the first positioning holes 13 of the adjustment rod 11 to complete the installation of the packing film roll 200. Afterward, the packing film 201 on the packing film roll 200 is pulled out. The user holds the first handle 14 and the second handle 46 with both hands. The long-handle film packing device 100 is moved toward the article to be packed to complete the packing procedure.

It is noted that the limit member 43 of the holding rod 41 is aimed at the limit groove 12 of the adjustment rod 11 to be positioned quickly. During installation and use, the adjustment rod 11 won't rotate relative to the holding rod 41 so as to adjust the length of the long-handle film packing device 100 in accordance to the packing film roll 200.

Figure 6:
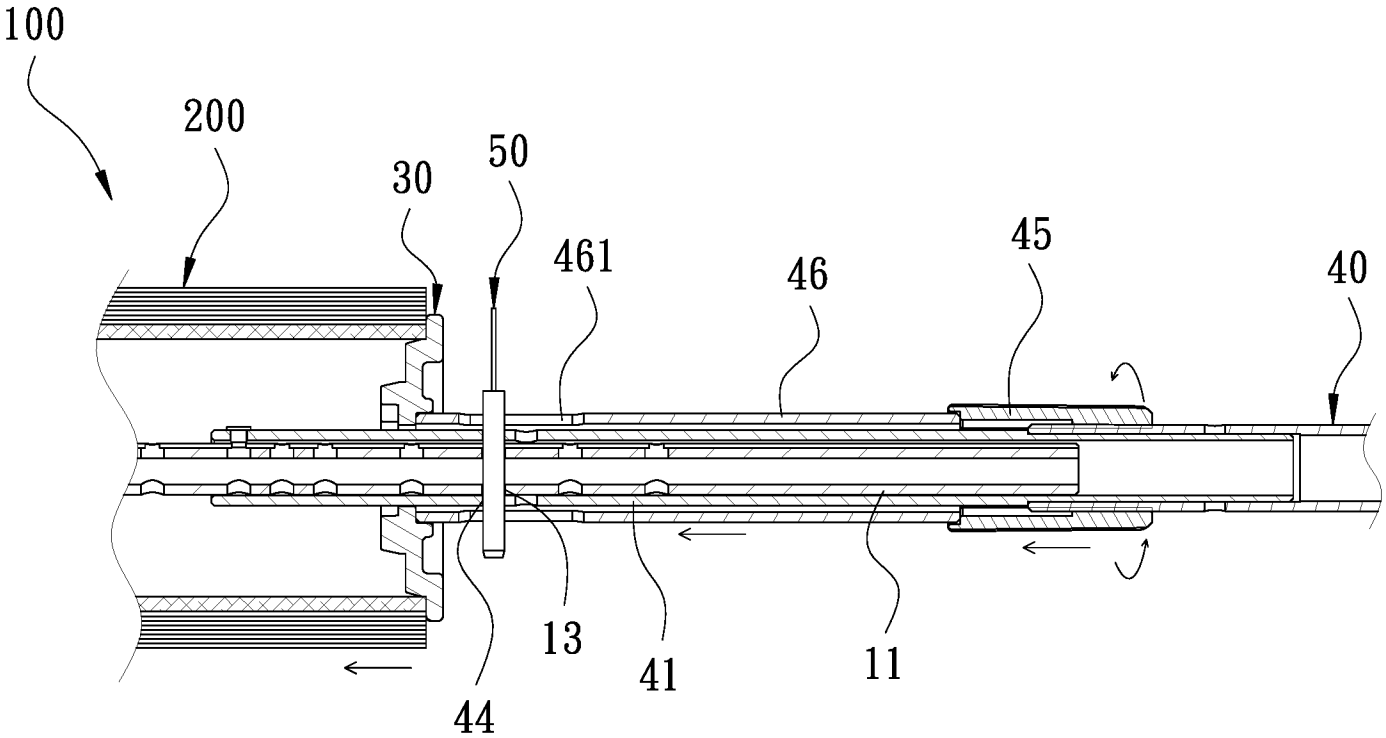
FIG. 6 is a schematic view showing the adjustment of tension of the first embodiment of the present invention after assembled.

FIG. 6 is a schematic view showing the adjustment of tension of the first embodiment of the present invention after assembled. When the long-handle film packing device 100 needs to tighten the tension, the knob 45 is rotated toward the packing film roll 200. The knob 45 pushes the second handle 46. Through the slot 461 of the second handle 46, the second handle 46 is moved toward the second cover 30. The second handle 46 can be axially moved relative to the positioning pin 50, the holding rod 41, and the adjustment rod 11 to push the second cover 30 and the packing film roll 200 so as to increase the tension of the long-handle film packing device 100, such that the packing procedure is more smooth and convenient.

It is noted that the positioning pin 50 is inserted in the slot 461 of the second handle 46, the second positioning hole 44 of the holding rod 41, and one of the first positioning holes 13 of the first adjustment rod 11 to limit the second handle 46. The second handle 46 can be axially moved only. The adjustment rod 11 won't rotate relative to the holding rod 41 to keep the tension of the packing film roll 200 when applied.

In the present invention, the second end of the first rod 10 is fixedly connected with the first handle 14. During installation and use, the handle 14 not only retains the packing film roll 200 but also ensures safety of use for the user.

Figure 7:
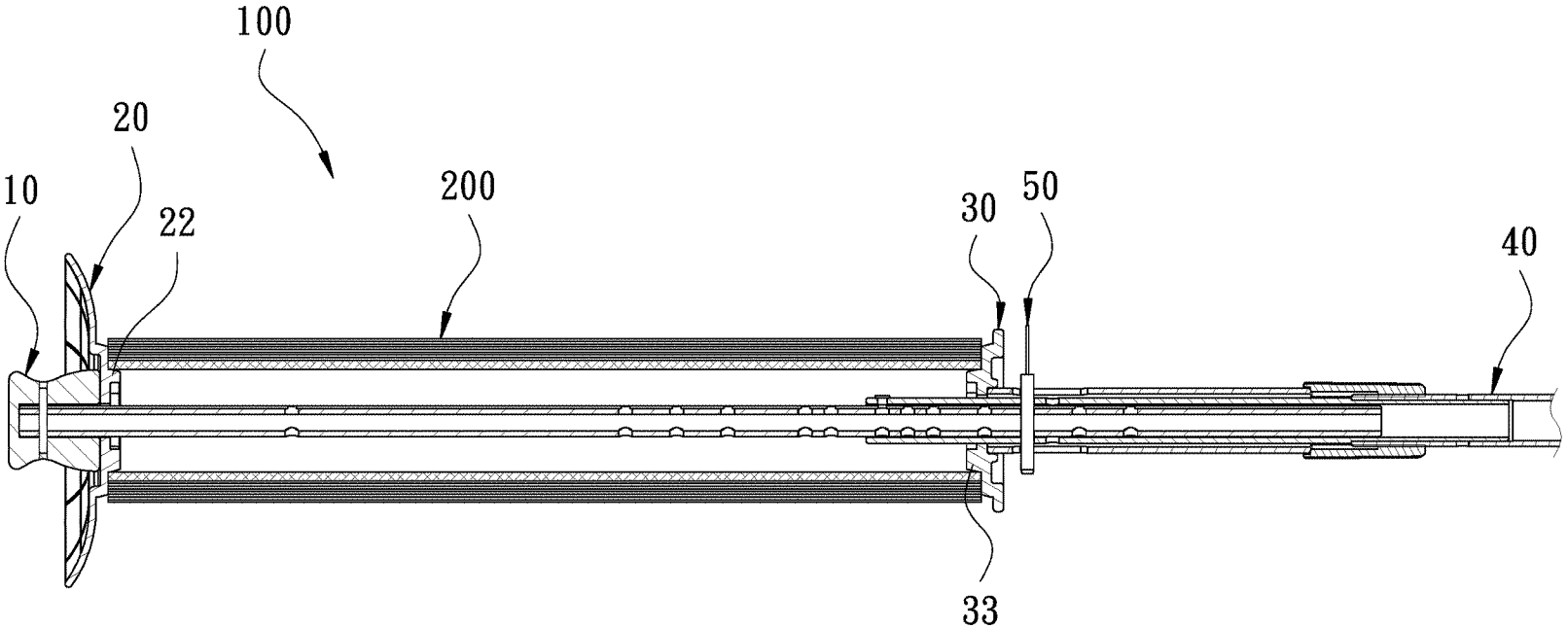
FIG. 7 is a partial sectional view according to a second embodiment of the present invention.

FIG. 7 is a partial sectional view according to a second embodiment of the present invention. The installation steps of the second embodiment are substantially similar to the aforesaid first embodiment with the exceptions described hereinafter. The packing film roll 200 is a two-inch packing film roll 200. Two ends of the packing film roll 200 are mounted to the second receiving block 22 and the fourth receiving block 33, such that the present invention can be applied to the two-inch packing film roll 200.

Figure 8:
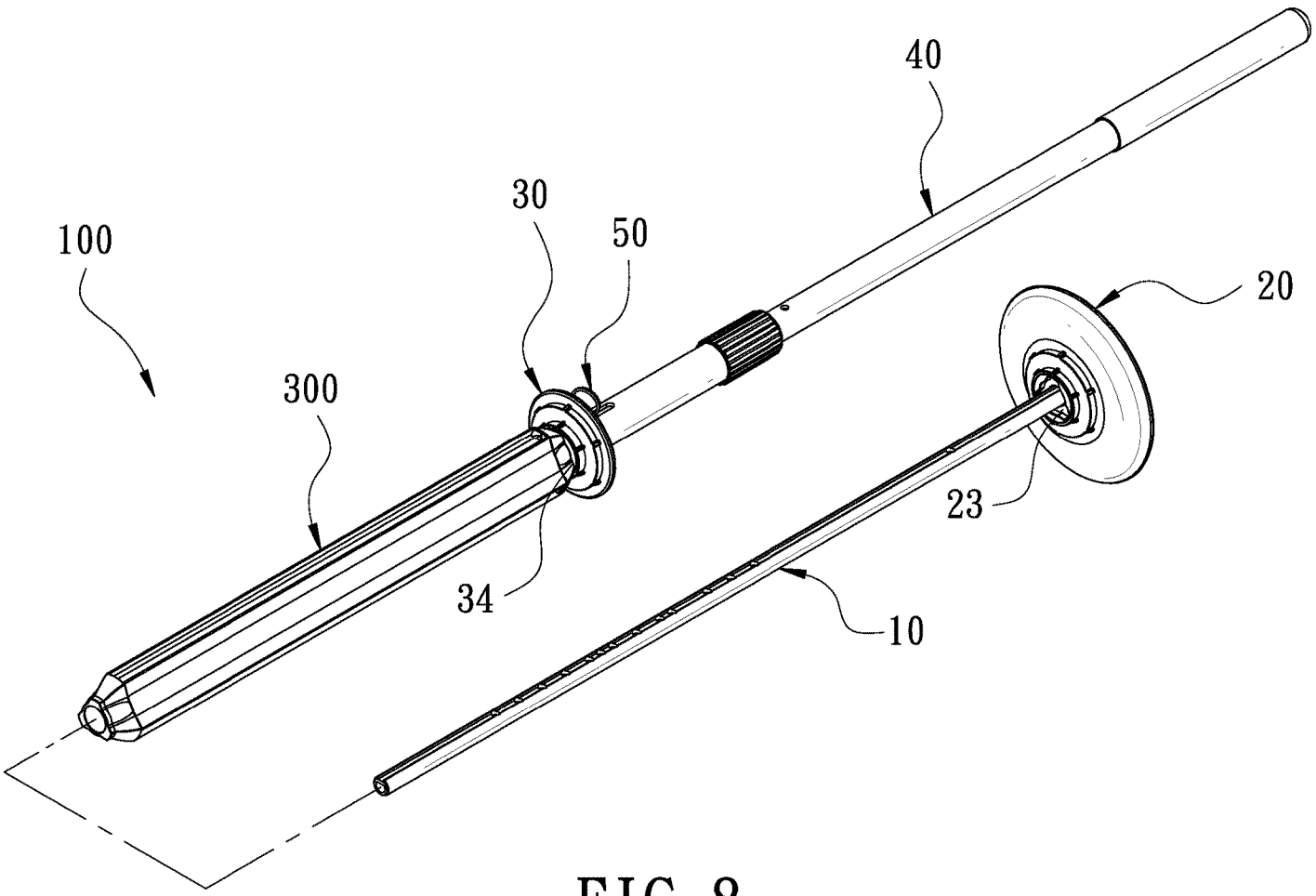
FIG. 8 is an exploded view according to a third embodiment of the present invention.

FIG. 8 is an exploded view according to a third embodiment of the present invention. The installation steps of the third embodiment are substantially similar to the aforesaid first embodiment with the exceptions described hereinafter. In the third embodiment, two ends of a connector 300 are connected to the first receiving recess 23 and the second receiving recess 34. The connector 30 can be fitted with a packing film roll not having a reel. The present invention is applied to not only different lengths and diameters of packing film rolls 200 but also packing film rolls having or not having a reel. The present invention is environment-friendly.

Thereby, through the limit member 43 limited to the limit groove 12, the length of the long-handle film packing device 100 can be adjusted quickly. Through the positioning pin 50, the long-handle film packing device 100 can positioned quickly. The present invention can be applied to different lengths of packing film rolls 200. In addition, the packing film roll 200 can be first mounted, and then the length of the film packing device is adjusted. Except that the length of the present invention can be adjusted and positioned quickly, the present invention has better practicability and convenience for installation.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A long-handle film packing device, comprising:

a first rod, the first rod having an adjustment rod, an outer wall of the adjustment rod being formed with an axial limit groove, the limit groove extending from a first end of the adjustment rod toward a second end of the adjustment rod, the first rod being formed with a plurality of spaced positioning holes at a bottom of the limit groove, the second end of the first rod is fixedly connected with a first handle;

a first cover, the first cover being fitted on the adjustment rod and located between the first positioning holes and the first handle, the first cover leaning against the first handle;

a second cover, the second cover being fitted on the adjustment rod;

a second rod, the second rod having a holding rod and a knob, the holding rod having an axial hole for receiving the adjustment rod, the holding rod being provided with a limit member close to a first end of the holding rod, the holding rod being formed with at least one second positioning hole located close to the limit member and corresponding to the first positioning holes, the knob being threadedly connected in between a second end of the holding rod and the second positioning hole, the holding rod being sleeved with a second handle, one end of the second handle leaning against the knob, a free end of the second handle leaning against the second cover, an outer wall of the second handle being axially formed with a slot corresponding to the first positioning holes and the second positioning hole; and a positioning pin, the positioning pin being inserted in the slot of the second handle, the second positioning hole of the holding rod, and one of the first positioning holes of the first adjustment rod.

2. The long-handle film packing device as claimed in claim 1, wherein one side of the first cover, facing the first positioning holes, is provided with a first receiving block and a second receiving block on top of the first receiving block, and one side of the second cover, facing the first cover, is provided with a third receiving block corresponding to the first receiving block and a fourth receiving block on top of the third receiving block corresponding to the second receiving block.

3. The long-handle film packing device as claimed in claim 2, wherein the first receiving block, the second receiving block, the third receiving block, and the fourth receiving block are substantially in a disk shape, the first receiving block has a diameter greater than that of the second receiving block, and the third receiving block has a diameter greater than that of the fourth receiving block.

4. The long-handle film packing device as claimed in claim 3, wherein the diameter of the first receiving block and the third receiving block is three inches, and the diameter of the second receiving block and the fourth receiving block is two inches.

5. The long-handle film packing device as claimed in claim 2, wherein a top of the second receiving block is formed with a first receiving recess, a top of the fourth receiving block is formed with a second receiving recess corresponding to the first receiving recess, and the first receiving and the second receiving are configured to receive a connector used for a packing film roll not having a reel.

6. The long-handle film packing device as claimed in claim 1, wherein one side of the second cover, facing the first end of the adjustment rod, is formed with a first trough.

7. The long-handle film packing device as claimed in claim 1, wherein one side of the knob, facing the second positioning hole, is formed with a second trough, and one end of the second handle leans against the second trough of the knob.

8. The long-handle film packing device as claimed in claim 1, wherein the limit member is a pin, the limit member penetrates through an outer wall of the holding rod and extends out of an inner wall of the holding rod.

* * * * *